US009732500B2

(12) United States Patent
Harsia et al.

(10) Patent No.: US 9,732,500 B2
(45) Date of Patent: Aug. 15, 2017

(54) CUSHIONED SWING CIRCUIT

(75) Inventors: Jarmo Harsia, Chicago, IL (US); Roger Lowman, Simpsonville, SC (US); Germano Franzoni, Prairie View, IL (US)

(73) Assignee: Parker Hannifin Corporation, Cleveland, OH (US)

( * ) Notice: Subject to any disclaimer, the term of this patent is extended or adjusted under 35 U.S.C. 154(b) by 755 days.

(21) Appl. No.: 14/005,421

(22) PCT Filed: Mar. 15, 2012

(86) PCT No.: PCT/US2012/029176

§ 371 (c)(1),
(2), (4) Date: Jul. 18, 2014

(87) PCT Pub. No.: WO2012/125793

PCT Pub. Date: Sep. 20, 2012

(65) Prior Publication Data

US 2014/0318113 A1 Oct. 30, 2014

Related U.S. Application Data

(60) Provisional application No. 61/452,661, filed on Mar. 15, 2011.

(51) Int. Cl.

| | |
|---|---|
| ***F15B 11/04*** | (2006.01) |
| ***E02F 9/22*** | (2006.01) |
| ***E02F 3/38*** | (2006.01) |

(52) U.S. Cl.

CPC ..... *E02F 9/2207* (2013.01); *E02F 3/384* (2013.01); *F15B 2211/45* (2013.01); *F15B 2211/853* (2013.01)

(58) Field of Classification Search

CPC ..... F15B 11/0406; F15B 2211/45; F15B 2211/853

See application file for complete search history.

(56) References Cited

U.S. PATENT DOCUMENTS

| | | | |
|---|---|---|---|
| 4,066,004 | A | 1/1978 | Alcalay |
| 4,344,733 | A | 8/1982 | Hirsch |
| 5,025,626 | A | 6/1991 | Crosser et al. |

(Continued)

FOREIGN PATENT DOCUMENTS

| | | | |
|---|---|---|---|
| JP | 10-310365 | A | 3/1998 |

OTHER PUBLICATIONS

International Search Report and Written Opinion for corresponding International Application No. PCT/US2012/029176 dated Jun. 14, 2012.

(Continued)

*Primary Examiner* — F. Daniel Lopez

(74) *Attorney, Agent, or Firm* — Renner, Otto, Boisselle & Sklar, LLP

(57) ABSTRACT

A cushioned swing circuit provides the reduction of oscillation common in the operation of heavy equipment such as with boom members. The circuit utilizes a transfer of high pressure fluid flow (caused by the inertial of the swing during rapid deceleration) from one leg of the circuit to the other leg of the circuit or to the sump which serves as decompression for the oil that would ordinarily be trapped in the leg. These phenomena create the swing cushioning effect.

8 Claims, 6 Drawing Sheets

(56) References Cited

U.S. PATENT DOCUMENTS

| | | | | |
|---|---|---|---|---|
| 5,941,155 | A * | 8/1999 | Arai | E02F 9/123 60/468 |
| 6,220,027 | B1 | 4/2001 | Heusser | |
| 6,532,738 | B2 | 3/2003 | Sharkness et al. | |
| 7,383,682 | B2 | 6/2008 | Kauss | |
| 2003/0084663 | A1 | 5/2003 | Heyne et al. | |
| 2005/0072474 | A1 | 4/2005 | Jervis et al. | |

OTHER PUBLICATIONS

English translation of Chinese Office Action in corresponding Chinese Application No. 201280023542.X dated Jan. 29, 2015.
English translation of Chinese Notification of Granting Patent Right in corresponding Chinese Application No. 201280023542.X dated Sep. 18, 2015.
European Intention to Grant in corresponding European Patent Application No. 12 712 478.2 dated Jul. 7, 2015.

* cited by examiner

CUSHIONED SWING CIRCUIT

CROSS-REFERENCE TO RELATED CASES

This application is a national phase of International Application No. PCT/US2012/029176 filed Mar. 15, 2012 and published in the English language, which claims priority to U.S. Provisional Application 61/452,661 filed Mar. 15, 2011, which is hereby incorporated herein by reference.

This application claims the benefit of U.S. Provisional Application Ser. No. 61/452,661; filed Mar. 15, 2011, the disclosure of which is expressly incorporated herein by reference.

TECHNICAL FIELD

The present invention relates to hydraulic systems used in the operation of heavy equipment. More specifically, the invention relates to a cushioned swing circuit used to alleviate harsh oscillation common in the operation of heavy equipment.

BACKGROUND

In general, construction and other heavy equipment use hydraulic systems to perform digging, loading, craning, and like operations. The speed and direction of these functions are controlled with hydraulic valves. Typically at the end of a moving function, the assembly exhibits uncontrolled changes in speed and direction producing an oscillatory motion. For example, in a backhoe, the oscillatory motion occurs when its linkage is brought to a stop following a side-to-side maneuver. This oscillation makes it more difficult for the backhoe operator to return the bucket to a given position. The oscillation is caused when the kinetic energy generated by the backhoe movement is transferred to the hydraulic supply lines connected to the backhoes actuators when stopping. The transferred energy produces a sharp increase (or spike) in fluid pressure in the stopping actuator. The increased fluid pressure transfers the energy into the hydraulic system and the surrounding vehicle. The energy then returns in the opposite direction through the hydraulic lines and exerts the force into the original driving actuator. This transfer of energy continues until it is dispelled as heat, or is dissipated through the oscillation of the equipment and the swelling of the hydraulic lines.

Hydraulic swing dampening or cushioned swing circuits have been designed to compensate for this oscillation. Prior art cushioned swing circuits sometimes have a restricted passage between the cylinder/motor conduits to allow the implement controlled by the swing circuit to coast to a stop. However, opening and closing of the restricted passage was controlled by a three position two-way valve keeping the passage open all the time when swing is in motion. This causes a loss during acceleration and swing propel that is not desired.

SUMMARY

At least one embodiment of the invention provides a hydraulic cushion circuit comprising: a bi-directional hydraulic cylinder; a directional control valve; first and second cylinder conduits individually connected to the directional control valve and the hydraulic cylinder; a pump; a sump; a means for connecting the first cylinder conduit to at least one of the second cylinder conduit or the sump; wherein the means for connecting the first cylinder conduit to at least one of the second cylinder conduit or the sump includes a first flow restrictor and a first one way check valve oriented to prevent flow from the second to the first cylinder conduit if the connection is made between the first cylinder conduit and the second cylinder conduit, and including a first flow restrictor if the connection is made between the first cylinder conduit and the sump; a means for connecting the second cylinder conduit to at least one of the first cylinder conduit or the sump; wherein the means for connecting the second cylinder conduit to at least one of the first cylinder conduit or the sump includes a second flow restrictor and a second one way check valve oriented to prevent flow from the first to the second cylinder conduit if the connection is made between the second cylinder conduit and the first cylinder conduit, and including a second flow restrictor if the connection is made between the second cylinder conduit and the sump; wherein fluid flows from one cylinder conduit to either the sump or the other cylinder conduit when the fluid flow supplied by a pump through the directional control valve to the cylinder is greater than a predetermined flow value.

At least one embodiment of the invention provides a hydraulic cushion circuit comprising: a bi-directional hydraulic cylinder; a directional control valve; first and second cylinder conduits individually connected to the directional control valve and the hydraulic cylinder; a first vent conduit connecting the first and second cylinder conduits, the first vent conduit including a first variable restrictor and a first one way check valve preventing flow from the first cylinder conduit to the second cylinder conduit and; a second vent conduit connecting the first and second cylinder conduits, the first vent conduit including a second variable restrictor and a second one way check valve preventing flow from the second cylinder conduit to the first cylinder conduit; wherein one of the variable restrictors opens when fluid flow supplied by a pump through the directional control valve to the cylinder is greater than a predetermined flow value allowing the fluid to flow from one cylinder conduit to the other cylinder conduit only when a pressure in the one cylinder conduit exceeds the pressure in the other cylinder conduit.

At least one embodiment of the invention provides a hydraulic cushion circuit comprising: a bi-directional hydraulic cylinder; a directional control valve; an oil sump; first and second cylinder conduits individually connected to the directional control valve and the hydraulic cylinder; a first vent conduit connecting the first cylinder conduit to the oil sump, the first vent conduit including a first variable restrictor; a second vent conduit connecting the second cylinder conduit to the oil sump, the second vent conduit including a second variable restrictor; wherein one of the variable restrictors opens when fluid flow supplied by a pump through the directional control valve to the cylinder is greater than a predetermined flow value allowing the fluid to flow from one cylinder conduit to the sump.

At least one embodiment of the invention provides a hydraulic cushion circuit comprising: a bi-directional hydraulic cylinder; a directional control valve; an oil sump; a pump; first and second cylinder conduits individually connected to the directional control valve and the hydraulic cylinder; wherein the directional control valve comprises a four-way, three position proportional spool with two transition positions; the three positions including a centrally positioned closed port neutral position, and a crossed supply and return a parallel supply and return positioned on distal ends of the spool; the two transient positions including a first transition position having a closed supply port and a connection of the second cylinder conduit to the sump, the connection including a restriction, and a second transition position having a closed supply port and a connection of the first cylinder conduit to the sump, the connection including a restriction; wherein the spool is shifted to either distal position when a swing operation is commanded, and if the swing supply flow overcomes a predetermined value, the spool is moved to an adjacent transition position and held for a predetermined time certain time prior to moving to the neutral position.

At least one embodiment of the invention provides a cushioned swing circuit comprising: a bi-directional hydraulic cylinder; a directional control valve; first and second cylinder conduits individually connected to the directional control valve and the hydraulic cylinder; a three position, three-way cushion valve connected to the first hydraulic conduit by a first vent line and connected to the second hydraulic conduit by a second vent line, the cushion valve moveable between a closed position blocking fluid flow through the vent lines, a first open position establishing fluid flow through the first vent line and a second open position establishing fluid flow through the second vent line; a third vent line directing fluid flow from the cushion valve to a pressure relief valve and alternatively to the first hydraulic conduit through a first check valve in a first branch of the third vent line, or to the second hydraulic conduit through a second check valve in a second branch of the third vent line; a flow restriction orifice disposed in one of the first and second hydraulic conduits for generating a pressure differential therein when fluid is flowing therethrough; a means for moving the cushion valve to the open position when the pressure differential exceeds a predetermined level; and said cushion valve including spring means for resiliently biasing the cushion valve to the closed position.

At least one embodiment of the invention provides a method for cushioning the stop of a swing boom having a pair bi-directional hydraulic cylinder, a directional control valve, and first and second cylinder conduits individually connected to the directional control valve and the hydraulic cylinder, the method comprising the steps of: providing a first vent conduit connecting the first and second cylinder conduits, the first vent conduit including a first variable restrictor and a first one way check valve preventing flow from the first cylinder conduit to the second cylinder conduit and; providing a second vent conduit connecting the first and second cylinder conduits, the first vent conduit including a second variable restrictor and a second one way check valve preventing flow from the second cylinder conduit to the first cylinder conduit; opening one of the variable restrictors when fluid flow supplied by a pump through the directional control valve to the cylinder is greater than a predetermined flow value; allowing fluid to flow from one cylinder conduit to the other cylinder conduit through the one-way check valve when a pressure in the one cylinder conduit exceeds the pressure in the other cylinder conduit.

BRIEF DESCRIPTION OF THE DRAWINGS

Embodiments of this invention will now be described in further detail with reference to the accompanying drawings, in which.

DETAILED DESCRIPTION OF THE DRAWINGS

Figure 1:
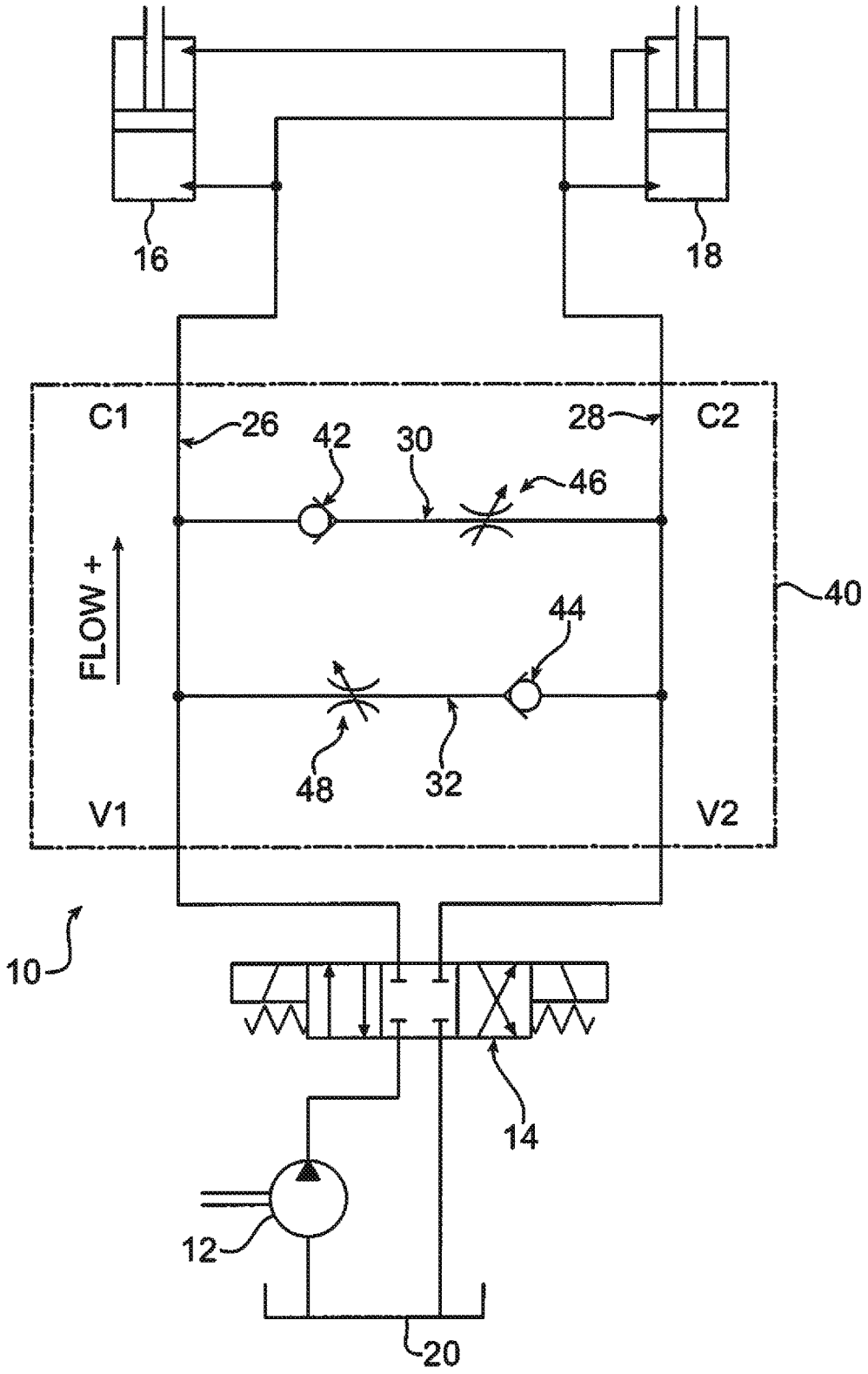
FIG. 1 is a schematic of a first embodiment of a hydraulic circuit showing the cushioned swing circuit of the present invention.

Referring to FIG. 1 a cushioned swing circuit 10 according to a first embodiment is shown in a "cross-over" configuration. The cushioned swing circuit 10 controls fluid flow to and from a pair of bi-directional hydraulic cylinders 16, 18. The hydraulic cylinders 16, 18 are utilized for controlling the swinging motion of a rotatable mechanism such as a boom (not shown) of a backhoe and have their opposite ends suitably interconnected such that as the first hydraulic cylinder 16 extends, the second hydraulic cylinder 18 retracts and vice-versa. A directional control valve 14 is connected to a pump 12 and to a tank 20 in the usual manner. The pump may be a fixed or variable pump as is known in the art. The directional control valve may be any appropriate valve as known in the art including a proportional control valve. First and second fluid conduits 26, 28 are individually connected to the directional control valve 14 and to the opposite ends of the hydraulic cylinders 16, 18. A pair of cross-over fluid pathways 30, 32 connect fluid conduits 26, 28 as shown in the area designated with the broken line as 40. Each cross-over fluid pathway has a unidirectional valve 42, 44 that allow flow only in one direction. Each cross-over fluid pathway 30, 32 also has a variable restrictor 46, 48. The term variable restrictor is defined herein as a element that can be closed to prevent flow therethrough or opened in a manner restricting flow therethrough such as by an orifice. The opening or closing of these paths can be controlled hydromechanically (e.g. with a handle or a pilot pressure) or electrically (e.g. by a solenoid). The term flow restrictor is defined herein as a fixed orifice or a pressure control device and can include a variable restrictor.

In operation, a preset value of flow (supplied by the pump to the cylinders through the directional valve) is designated as Q0 and corresponds to a preset speed of the cylinder system supplied by ports C1 and C2. The flow Q0 can be measured in the positive direction (from V1 to C1, i.e. from C2 to V2) or in the negative direction (from C1 to V1, i.e. from V2 to C2).

Q is the commanded flow by the operator, which is related to the operator's interface position (e.g. joystick position—not shown) and it is supplied from the pump 22 to the cylinders 30, 32 through the directional valve 20. When the absolute value of the flow Q exceeds the value Q1, one of the variable restrictions (46 or 48) opens. In particular, if $Q>Q1$ is positive, variable restrictor 46 opens and, vice versa, if $Q<-Q0$ is negative, variable restrictor 48 opens. Once the value of the flow rate Q decreases below Q1 (i.e. the swing system comes to a deceleration or a stop), then the restrictor orifice that is open (46 or 48), closes. However, the closing of the restrictor orifice happens with a delay, with respect to the event of a flow rate $Q<Q1$ (in absolute value).

Application to the swing circuit: when the operator commands a swing operation, oil flows in the system. For example, if Q>0 the supply oil goes from V1 to C1 ports and the return oil goes from C2 to V2. If the swing flow Q overcomes a preset threshold value Q1 (note that Q1 can be any preset value), then restrictor 46 opens. However, since the supply flow is going from V1 to C1, this leg of the circuit is at higher pressure than the opposite leg (C2 to V2). Therefore, the check valve 42 prevents oil flow through restrictor 46. When the operator commands a swing deceleration (so that Q<Q0) or stop (Q=0), then the restrictor orifice 46 remains open for a certain amount of time (e.g. 1.5 seconds). Now the swing rapidly decelerates and, due to its inertia, the leg of the circuit C2-V2 will see higher pressure than C1-V1. Therefore, during this phase, there will be oil flow going from C2-V2 to C1-V1 which serves as decompression for the oil that would otherwise be trapped in the C2-V2 leg. These phenomena create the swing cushioning effect.

The same scenario (but with opposite signs for the values of Q and Q1) happens when the operator commands the swing operation in the opposite direction.

Figure 2:
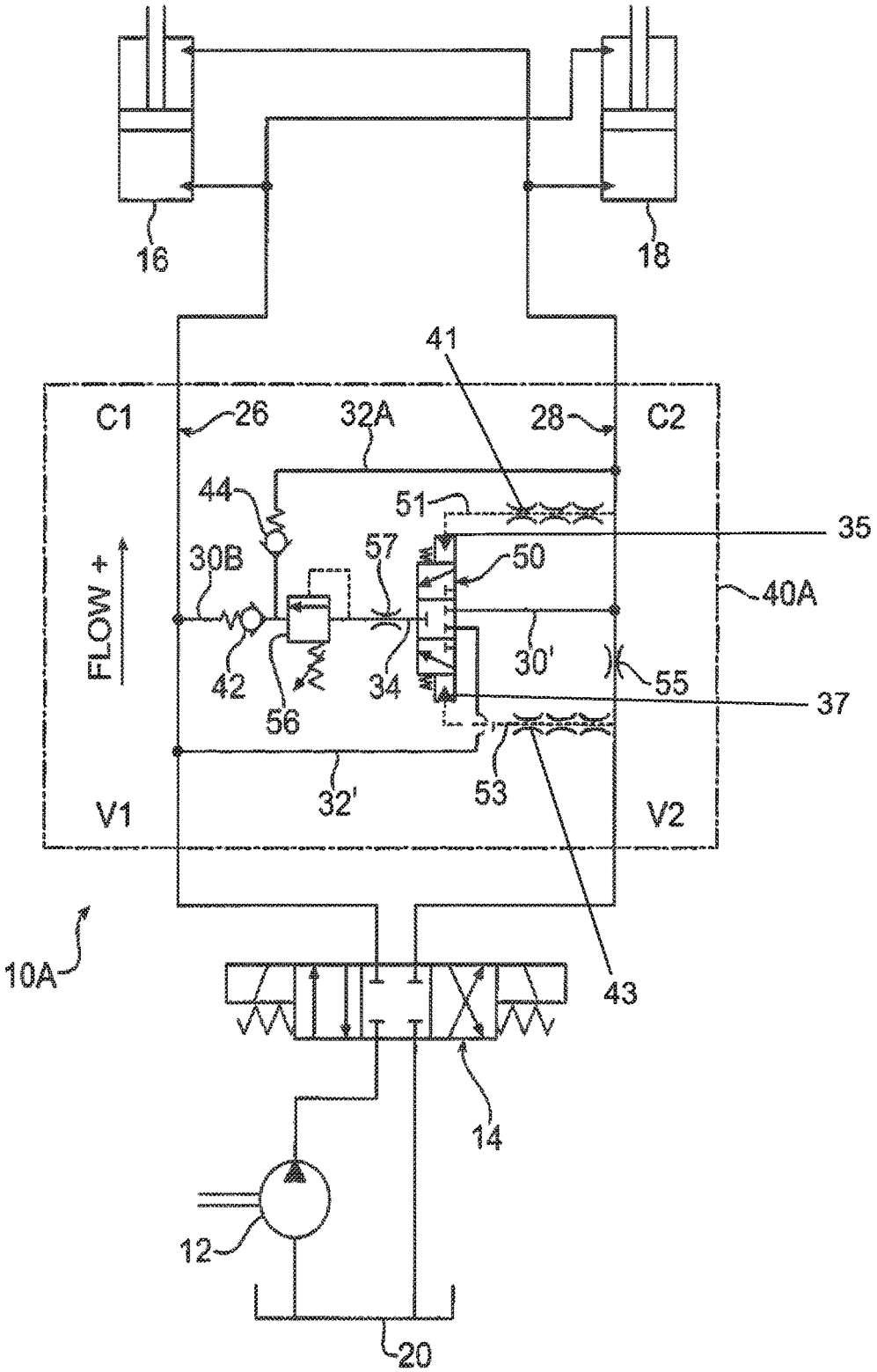
FIG. 2 is a schematic of an embodiment of a hydraulic circuit showing the cushioned swing circuit of the present invention with the three-way, three position cushion valve shown in the closed position.

Referring now to FIG. 2, another embodiment of the cushion swing circuit 10A is shown. The circuit 10A is the same as circuit 10 except for as designated at 40A showing a different type of cross-over configuration. The circuit 10A comprises a first hydraulic conduit 26 and a second hydraulic conduit 28 as in the previous embodiment. A three position, three-way cushion valve 50 is disposed between and selectively connected to the second conduit 28 by a first cross-over line 30' and selectively connected to the first conduit 26 by cross-over line 32'. The first and second cross-over lines 30', 32' selectively and alternatively providing fluid flow to the cushion valve 50 under predetermined conditions. Fluid leaving the cushion valve 50 is directed through conduit 34 and through orifice 57, through pressure relief valve 56 and then to either the first hydraulic conduit 26 through check valve 42 or to the second hydraulic conduit 28 through check valve 44.

One of the hydraulic conduits 28 includes a flow restrictor orifice 55 for generating a pressure differential in the hydraulic conduit 28 when fluid is flowing therethrough. The cushion valve 50 is moved to the appropriate open position when the pressure differential in the fluid in the second conduit 28 exceeds a predetermined level. A pair of pilot passages 51, 53 connected to the actuating chambers 35, 37, respectively. The pilot passages 51, 53 are connected to the second motor conduit 30' on opposite sides of the flow restrictor orifice 55. A plurality of restrictor orifices 41, 43 are shown disposed in the pilot passages 51, 53 respectively, to retain the cushion valve 50 in the open position for a predetermined limited time after the pressure differential drops below the preselected level thus causing the delay as with the first embodiment. Although a plurality of orifices is shown, this function may be accomplished by a single orifice. The cushion valve 50 includes springs for resilient biasing the valve to the centered closed position.

The passage between the conduits 26, 28 only needs to be connected during deceleration. With the three-way, three position cushion valve 50 the logic can be created so only the return side has passage to the supply side over a relief valve 56 and check valve 42 or 44. This connection is established when a pressure differential greater than a predetermined level is generated in one of the cylinder/motor conduits connecting a directional control valve 14 to a hydraulic cylinder 16, 18. The cushion valve 50 is retained in the open position for a predetermined limited time after the pressure differential drops below the predetermined level so that the inertia generated pressure in the return side of the circuit is dissipated through the connection over the relief valve 56 and check valve 57 between return and supply side. At the end of the predetermined limited time, the cushion valve 50 is moved to the center (closed) position blocking communication between the cylinder/motor conduits whereupon the circuit is hydraulically locked. The cushion valve 50 is moved between the opened and closed positions automatically and requires no additional effort by the operator.

The purpose of the invention 10A is to reduce braking power toward the end of stopping in a swing function so the dig arm can recoil and therefore wag less. The speed when anti-swag engages is determined by the fixed orifice 55. The stopping speed when reduced braking engages is determined by fixed orifice 57. The final deceleration is controlled by the relief valve 56. This gives a more precise stop that makes it easier and faster for the operator to hit the desired spot to stop on.

Figure 3:
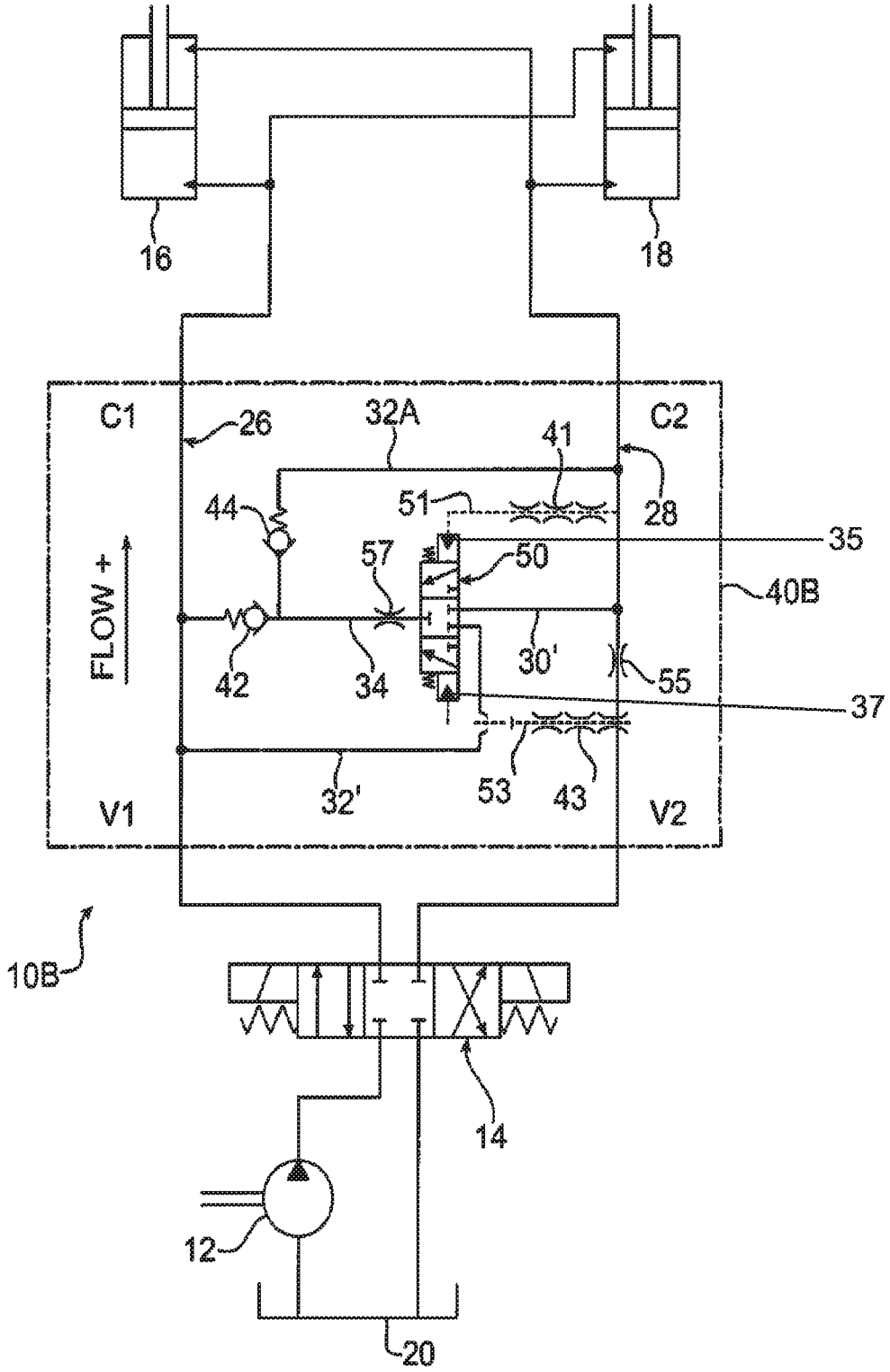
FIG. 3 is a schematic of the embodiment shown in FIG. 2 but having a pressure relieve valve removed from the output conduit of the cushion valve.

Referring to another embodiment in FIG. 3, the circuit 10B is the same as circuit 10A except that the relief valve 56 has been removed and thus the stopping speed when reduced braking engages is determined by the fixed orifice 57.

Figure 4:
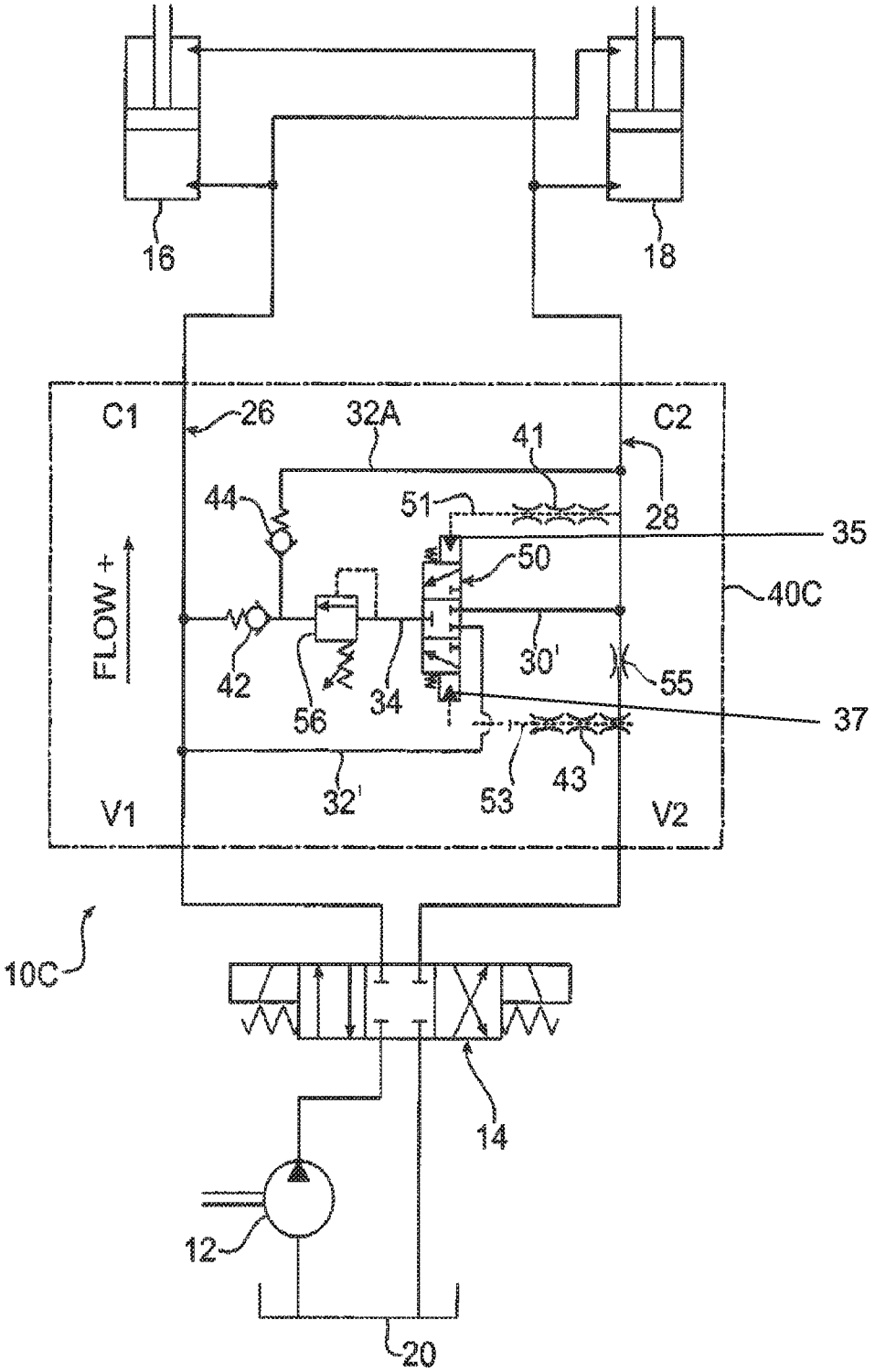
FIG. 4 is a schematic of the embodiment shown in FIG. 2 but having a fixed orifice restrictor removed from the output conduit of the cushion valve.

Referring to another embodiment in FIG. 4, the circuit 10C is the same as circuit 10A except that the fixed orifice 57 has been removed and thus the stopping speed when reduced braking engages is determined by the restriction created by the orifice of the relief valve 56.

Figure 5:
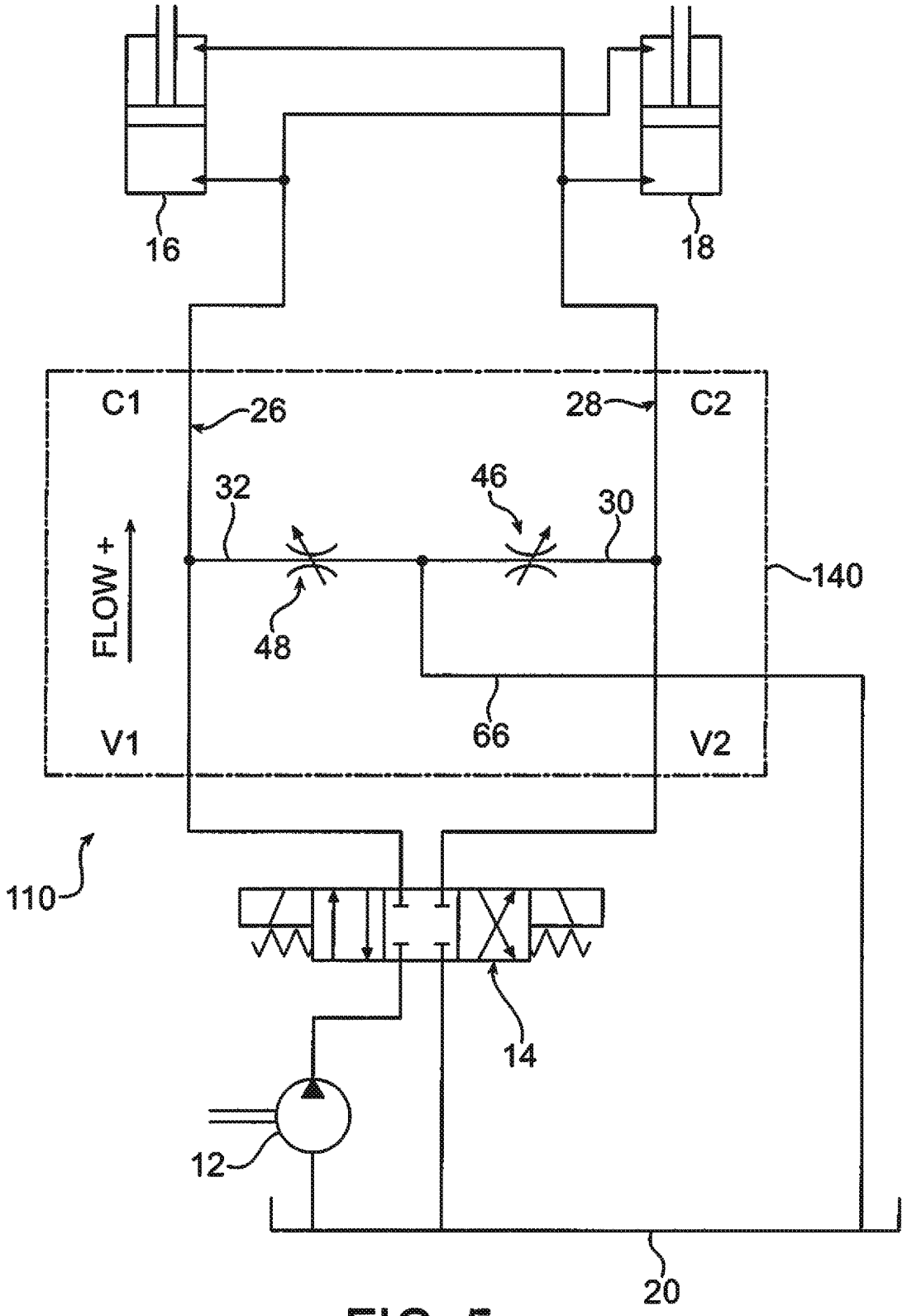
FIG. 5 is another embodiment of the cushioned swing circuit wherein the flow is vented to a sump tank.

Another embodiment of the invention is provided in FIG. 5 wherein the circuit is designated as 110 and Is slightly different than the previous embodiments as there is no cross-over. Here, the variable flow restrictors 46 and 48, instead of connecting one leg of the circuit to the opposite one, connect each leg of the circuit to tank 20.

The principle of operation is slightly different: the operator commands a movement of the cylinders with a supply flow Q. If the absolute value of Q overcomes a preset value Q0, the variable restrictor orifices 46, 48 stay closed. However, as soon as the supply flow goes back to 0 (the cylinder is commanded to a stop), then one of the variable restrictions 46 or 48 opens. In particular, if the flow Q comes to 0 from the positive side, variable restrictor 46 opens, while if Q come from the negative side, variable restrictor 48 opens. Whichever orifice has opened, it stays open for a certain time after the event. After this time, it closes again.

Application to the swing circuit: when the operator commands a swing operation, oil flows in the system. For example, if Q>0 the supply oil goes from V1 to C1 ports and the return oil goes from C2 to V2. If the swing flow overcomes a preset threshold value Q1 (note that Q1 can be any preset value), then nothing happens, but the cushioning system is triggered. In fact, when the operator closes the swing supply (he commands the swing to stop), orifice 46 opens and stay open for a certain time (e.g. 1.5 seconds). During this time the swing is still decelerating and, due to its inertia, the leg of the circuit C2-V2 will see a pressure increase. Therefore, during this phase, there will be oil flow going through 46 which serves as decompression for the oil that would otherwise be trapped in the C2-V2 leg. These phenomena create the swing cushioning effect.

The same scenario (but with opposite signs for the values of Q and Q1) happens when the operator commands the swing operation in the opposite direction. If Q0=0, then the cushioning effect is triggered anytime a swing operation is commanded.

Figure 6:
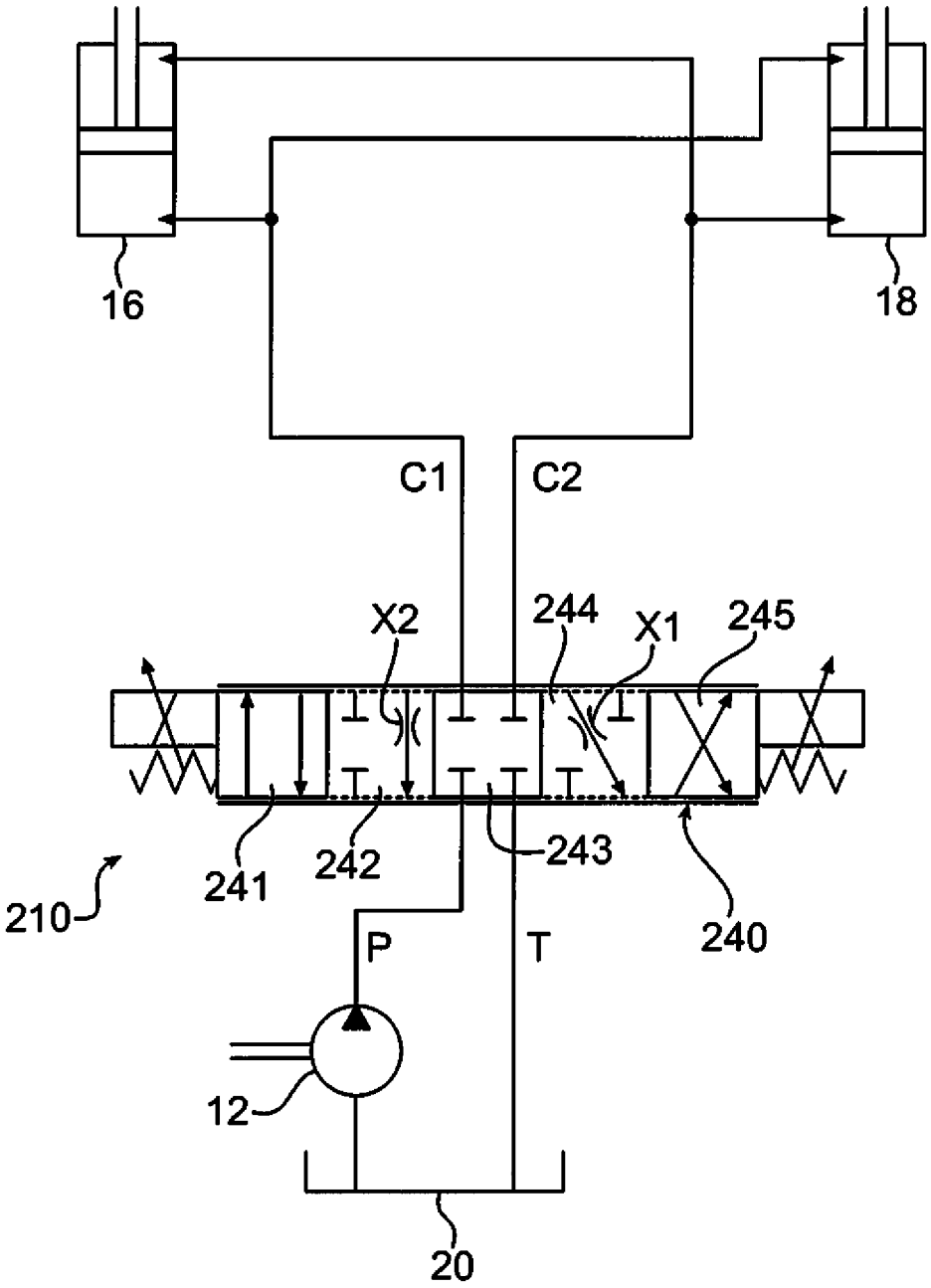
FIG. 6 is another embodiment of the cushioned swing circuit wherein the cushioning features are embodied in the directional control valve.

The same functionality as the embodiment of FIG. 5 is achieved by the embodiment described in FIG. 6. In this embodiment the swing circuit and the directional valve are replaced by a four-way (P, T, C1 and C2), 3 position proportional spool 240 which has a center position 243 with closed ports. The extreme left position 241 has parallel arrows (supply P to port C1 and return T to port C2). The extreme right position 245 has crossed arrows (supply P to port C2 and return T to port C1). Between the center position and the extreme positions, the spool has two transition positions (marked with dotted lines): in the left transition position 242 the ports P and C1 are closed while C2 is connected to T the restriction X2. In the right transition position 244 the ports P and C2 are closed while C1 is connected to T the restriction X1.

When the swing operation is commanded, the spool is shifted to either the parallel arrows 210 or crossed arrows 245 positions. If the swing supply flow overcomes the value Q1, then the cushioning system is triggered. As soon as the operator commands a swing stop, the spool is not commanded to the neutral position, but it is held in one of the transition positions for a certain time (e.g. 1.5 seconds). In particular, if C1 was the port connected to P, the cushioning transition position is the one identified by X2. Vice versa, if C2 was the supply port, the cushioning transition position is the one identified by X1. After the preset time has passed, the spool goes back to the center position 243 where all four ports are closed.

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention. Accordingly, the scope and content of the present invention are to be defined only by the terms of the appended claims.

The invention claimed is:

1. A hydraulic cushion circuit comprising:

a bi-directional hydraulic cylinder;

a directional control valve;

first and second cylinder conduits individually connected to the directional control valve and the hydraulic cylinder;

a pump;

a sump;

a first conduit connected to the first cylinder conduit and a second conduit connected to the second cylinder conduit;

a first one way check valve in the second conduit oriented to prevent flow from the second cylinder conduit;

a second one way check valve in the first conduit oriented to prevent flow from the first cylinder conduit;

a cushion valve connected to the first cylinder conduit by the first conduit and an outlet conduit, and connected to the second cylinder conduit by the second conduit and the outlet conduit, the cushion valve being operative to selectively move to a first open position to connect the second cylinder conduit to the outlet conduit, move to a second open position to connect the first cylinder conduit to the outlet conduit, or move to a closed position to prevent flow through the cushion valve;

a flow restrictor provided in the outlet conduit; and wherein the cushion valve moves to one of the first and second open positions when the fluid flow supplied by the pump through the directional control valve to the cylinder is greater than a predetermined flow value.

2. The circuit of claim 1, further comprising a flow restriction orifice in one of the first and second cylinder conduits a pair of pilot passages connected to opposite actuating chambers of the cushion valve and connected to the one of the first and second cylinder conduits on opposite sides of the flow restriction orifice, causing the cushion valve to move from the closed position to one of the first and second open positions when a pressure difference between the two pilot passages exceeds a predetermined level.

3. The circuit of claim 2, further comprising that each of the pilot passages includes at least one flow restricting orifice.

4. The circuit of claim 1, wherein the flow restrictor is provided by a fixed orifice positioned in outlet conduit or by a pressure relief valve positioned in the outlet conduit or by a fixed orifice and a pressure relief valve positioned in the outlet conduit.

5. A cushioned swing circuit comprising:

a bi-directional hydraulic cylinder, a directional control valve, first and second cylinder conduits individually connected to the directional control valve and the hydraulic cylinder, and a flow restriction orifice disposed in one of the first and second hydraulic conduits for generating a pressure differential therein when fluid is flowing through it, wherein the swing circuit includes:

a three position, three-way cushion valve connected to the first hydraulic conduit by a first vent line and connected to the second hydraulic conduit by a second vent line, the cushion valve moveable between a closed position blocking fluid flow through the vent lines, a first open position allowing fluid flow through the first vent line and a second open position allowing fluid flow through the second vent line, a third vent line directing fluid flow from the cushion valve to a flow restrictor and alternatively to the first hydraulic conduit through a first check valve in a first branch of the third vent line, or to the second hydraulic conduit through a second check valve in a second branch of the third vent line, in which the flow restrictor is provided by a fixed orifice positioned in the third vent line or by a pressure relief valve positioned in the third vent line or by a fixed orifice and a pressure relief valve positioned in the third vent line, and means for moving the cushion valve to one of the first or second open positions when the pressure differential exceeds a predetermined level, the cushion valve including spring means for resiliently biasing the cushion valve to the closed position.

6. The circuit of claim 5, in which the means for moving the cushion valve to the open position when the pressure differential exceeds a predetermined level is provided by a pair of pilot passages connected to actuating chambers, the pilot passages connected to the one of the first and second hydraulic conduits on opposite sides of the flow restriction orifice.

7. The circuit of claim 6, including at least one orifice disposed in each of the pilot passages.

8. The circuit of claim 5, which includes a second bidirectional hydraulic cylinder, the first and second conduit each being individually connected to the second bidirectional hydraulic cylinder.

* * * * *